United States Patent [19]

Wetzel et al.

[11] Patent Number: 4,797,198

[45] Date of Patent: Jan. 10, 1989

[54] PROCESS FOR THE WORKING UP OF SALVAGE OIL

[75] Inventors: Rolf Wetzel, Heiligenhaus; Hubert Coenen, Essen; Winfried Kreuch, Essen-Heisingen, all of Fed. Rep. of Germany

[73] Assignee: Krupp-Koppers GmbH, Essen, Fed. Rep. of Germany

[21] Appl. No.: 7,358

[22] Filed: Jan. 27, 1987

[30] Foreign Application Priority Data

Jan. 29, 1986 [DE] Fed. Rep. of Germany ..... 3602586

[51] Int. Cl.[4] ..... C10G 33/00

[52] U.S. Cl. ..... 208/181; 208/13; 208/45; 208/87; 208/88; 208/179; 208/184; 208/185; 208/187; 208/309; 208/427; 48/197 FM; 48/204; 201/23; 201/25

[58] Field of Search ..... 208/181, 184, 309, 45, 208/87, 88, 179, 180, 185, 187; 48/197 FM, 204; 201/23, 25

[56] References Cited

U.S. PATENT DOCUMENTS

| | | | |
|---|---|---|---|
| 3,074,882 | 1/1963 | Cross et al. | 208/309 |
| 3,507,777 | 4/1970 | Hemminger | 208/309 |
| 3,594,308 | 7/1971 | Sline | 208/309 |
| 3,864,242 | 2/1975 | Watanabe | 208/184 |
| 3,919,076 | 11/1975 | Cutler et al. | 208/184 |
| 4,021,333 | 5/1977 | Hubiby et al. | 208/184 |
| 4,233,140 | 11/1980 | Antonelli et al. | 208/184 |
| 4,333,822 | 6/1982 | Tkac et al. | 208/184 |
| 4,363,717 | 12/1982 | Pelrine et al. | 208/309 |
| 4,406,778 | 9/1983 | Borza et al. | 208/184 |
| 4,431,523 | 2/1984 | Tabler et al. | 208/184 |
| 4,482,453 | 11/1985 | Coombs et al. | 208/309 |
| 4,522,707 | 6/1985 | Kriegel et al. | 208/184 |
| 4,528,160 | 7/1985 | Zarchy | 208/309 |

*Primary Examiner*—H. M. S. Sneed
*Assistant Examiner*—Helane Myers
*Attorney, Agent, or Firm*—Michael J. Striker

[57] ABSTRACT

A process is disclosed for the working up of salvage oil, in which the salvage oil is subjected to an extraction under supercritical conditions. The halogen compounds contained in the produced extract are removed by catalytic hydrogenation. The extraction residue is eliminated by deposition or thermal treatment (gasification). In the case of a thermal treatment of the extraction residue, other residues can be simultaneously converted, so that the process is performed without yield of environmentally burdensome residues or by-products. Ethane in particular and/or propane is employed as solvent for the supercritical extraction.

20 Claims, 1 Drawing Sheet

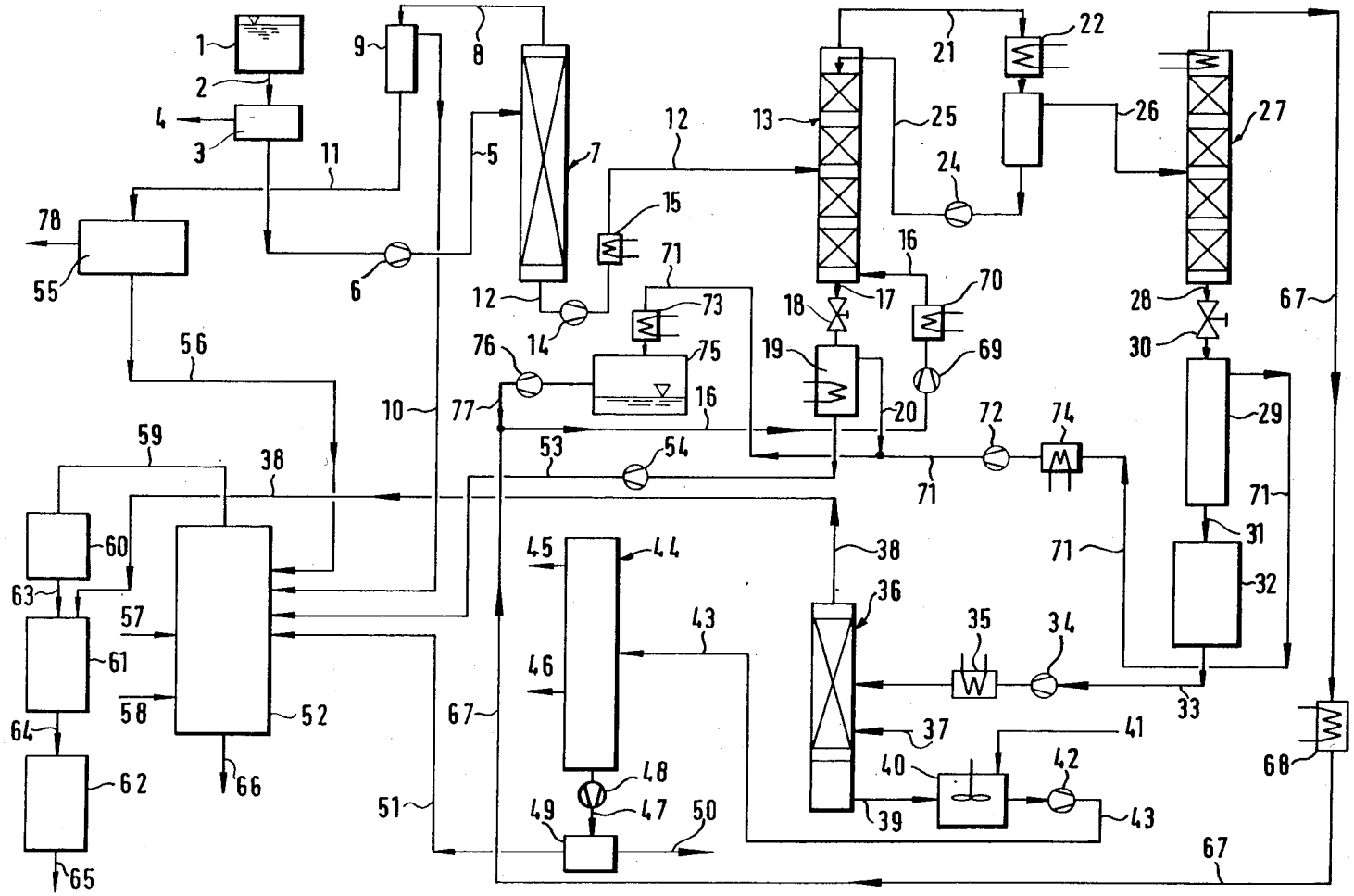

PROCESS FOR THE WORKING UP OF SALVAGE OIL

BACKGROUND OF THE INVENTION

The invention concerns a process for the working-up of salvage oil, in which the de-watered salvage oil is subjected to super-critical conditions using a solvent that is gaseous at normal conditions and subsequently, from the separated super-critical gas phase, the extracted components are deposited by means of lowering of pressure and/or alteration of temperature.

About fifty percent of all technically-utilized lubricating oils originate as impure salvage oil and can, insofar as they are accessible for collection, be introduced to a further utilization. This can occur either through combustion for the purpose of energy recovery or by means of raffination of the salvage oil for the purpose of employment anew as lubricating agent. The salvage oil to be worked up contains herewith impurities of the most various types, such as, e.g., so-called additives (metal compounds serving therefor), wear-and-tear residue and aging residue, as well as impurities which originate from improper storage of the salvage oil. These impurities of the most various types require on the one hand in connection with combustion of the salvage oil, particular measures for protection of the environment and must, on the other hand, be completely separated from the arising product that is to be re-employed, in the context of the raffination of the salvage oil.

The sulphuric acid/bleaching earth technique for raffination of the salvage oil has found particularly broad employment until now. The advantages of such a simple technique are counterbalanced, however, by slight yields, insufficient selectivity and greater amounts of problematical waste products, in the substantial acid resin and bleaching earth residue. Moreover, this technique does not guarantee the harmless elimination of particularly problematical injurious substances such as polychlorianted biphenyls, polychlorinated phenyls, halogen alkanes and polycondensed aromates.

More recent developments in the techniques for salvage oil raffination include:

the IFP-technique (substitution of sulphuric raffination by a super-critical propane extraction), the BERC-technique (solvent extraction, vacuum fractionation and bleaching earth or $H_2$-after treatment), the KTI-technique (vacuum-thin layer-distillation as purification stage), the PROP-technique (employment of ammonium phosphates for purification and $H_2$-after treatment), and the recycling technique (separation of the salvage oil impurities by means of sodium).

These techniques, with the exception of the KTI-technique, have not been able to furnish evidence of their essential process-technical qualification and economical technology in large-scale operations.

The KTI-technique with a thin layer evaporator as physical purification stage has indeed been employed on a large scale. The problem of the thin layer evaporation however, consists in the fouling of the heat-exchanger surfaces and the comparatively low selectivity of the technique.

It is already known, moreover, from German Offenlegungsschrifften Nos. 28 50 540 and 30 38 728 to undertake the working up of salvage oil by means of employment of an extraction under super-critical conditions, i.e. temperatures above $T_K$ and pressures about $P_K$. The manner of operation described in these publications, however, promotes no solution for the harmless elimination of the halogen compounds contained in the salvage oil. Considering today's requirements with regard to environmental protection, an employment of the super-critical extraction for working-up of salvage oil is only possible in practice, when this problem can be solved in satisfactory manner.

SUMMARY OF THE INVENTION

The invention is therefore based upon the object of further developing the techniques for the working-up of salvage oil involving super-critical extraction, so that the above-depicted problem of elimination is solved in satisfactory manner, whereby the working-up of the salvage oil can be performed without depositing into the environment, in irreversible manner a loading of residues and byproducts.

This object is attained according to the present invention by a process of the above-described type, with which the previously de-watered salvage oil is subjected to extraction under super-critical conditions using a normally-gaseous solvent and then from the separated super-critical gas phase the extracted components are deposited by means of lowering of pressure and/or temperature alteration, characterized by employment of the following steps:

(a) the solid impurities present in the salvage oil are removed by filtration;

(b) the filtered salvage oil is subjected to an atmospheric distillation in the temperature range between 120°-25° C.;

(c) the pre-distilled salvage oil is subjected to a super-critical extraction at pressures of from 50 up to 150 bar and temperatures from 20° C. up to 80° C., whereupon from the separated suepr-critical gas phase the components of the extract are deposited in one step or fractionated at pressures between 50 and 150 bar and temperatures between 40° C. and 200° C.;

(d) the deposited extract is freed of the solvent residue still remaining therein at temperatures between 40° C. and 200° C. by means of a single- or multiple-stage relaxation up to a pressure from 1 to 0.01 bar;

(e) the solvent-free extract is subjected to a catalytic hydrogenation at a pressure from 50 up to 150 bar and temperatures between 250° C. and 400° C., whereby the gas stream occurring from the hydrogenation is purified by means of pressure-water washing and/or pressure-caustic washing;

(f) the extraction residue resulting in the extraction stage is freed of dissolved solvent at temperatures between 40° C. and 200° C. by means of a single- or multiple-stage relaxation at a pressure from 1 up to 0.01 bar;

(g) the solvent-free extraction residue is eliminated by means of deposition or thermal treatment; and (h) the solvent recovered from the extraction residue is combined with the solvent recovered from the extract and after appropriate condensing added to the main solvent stream which is introduced into the extraction stage.

The process according to the present invention basically provides two possibilities for the elimination of the resulting solvent-free extraction residue. When circumstances permit, it is desirable for cost reasons to eliminate the extraction residue by means of storage in a deposit. However, when this is not possible, the extraction residue is eliminated by means of thermal treatment (gasification).

Further specific embodiments include the following: the hydrogenated extract if necessary with the addition of bleaching earth in an amount between 0 and 5% by weight, is fractionated by vacuum distillation.

The solvent-free extraction residue is gasified in a flame reaction in the presence of oxygen and/or air at temperatures between 1300° C. and 2000° C., the resulting gas composed essentially of the components carbon monoxide, hydrogen, carbon dioxide, water and nitrogen, being freed of undesirable components, particularly the metal compounds stemming from the oil additives, in a subsequent gas purification stage.

The diesel oil I resulting from the atmospheric distillation of the salvage oil is gasified together with the extraction residue.

The diesel oil I is admixed with the extraction residue, for the purpose of lowering the viscosity, before the gasification.

The oil-fouled bleaching earth resulting from vacuum distillation of the hydrogenated extract is suspended in the extraction residue and diesel oil I and gasified together with the same.

The water resulting upon atmospheric distillation of the salvage oil is gasified with the extraction residue.

The gasification of the water resulting upon atmospheric distillation of the salvage oil is effected along with an addition of fuel.

The water resulting from the atmospheric distillation of the salvage oil receives an addition of liquid hydrocarbon-containing byproduct before the gasification.

The water resulting from the atmospheric distillation of the salvage oil is run through a biological waste water purification and the thereby produced "clear slime" is gasified together with the extraction residue.

The solvent for the extraction is selected from ethane or propane as well as mixtures thereof.

An addition of butane is contained in the employed solvents, in a preferred embodiment.

BRIEF DESCRIPTION OF THE DRAWINGS

FIG. 1 is a schematic representation or flowchart of the process according to the present invention for the working up of salvage oil. Included in FIG. 1 are only those apparatus elements that are unconditionally necessary for illustration of the process, while additional arrangements, the specific details of which are not critical with regard to the process of the invention, are not represented.

The novel features which are considered characteristic of the invention are set forth in the appended claims. The invention itself, however, both as to its consturction and its method of operation, together with additional objects and advantages thereof, will be best understood from the following description of specific embodiments when read in connection with the accompanying drawing.

DESCRIPTION OF THE PREFERRED EMBODIMENTS

The salvage oil to be worked up is introduced from collection contain (1) across conduit (2) to the filter plant (3), in which the particles of solids are separated from the salvage oil by means of filtration and discharged across conduit (4). The salvage oil, now freed of solid particles, is led across conduit (5) and pump (6) into the distillation column (7). Here the salvage oil is subjected to a distillation under atmospheric pressure in the temperature range between 120° C. and 200° C. The diesel oil/water-mixture escaping across the top from the distillation column (7) is led across conduit (8) into the separation container (9), in which the water is separated from the diesel oil (so-called diesel oil I) by means of phase separation. The diesel oil is discharged through conduit (10) and the water through conduit (11) from the separation container (9). The pre-distilled and dewatered salvage oil discharged across conduit (12) from the distillation column (7) is introduced into the middle part of extraction column (13), which operates at a pressure between 50 and 150 bar and a temperature between 20° C. and 80° C. The pump (16) brings the salvage oil to the required operational pressure of extraction column (13) and heat exchanger (15) allows for the attainment of the required operaitonal temperature of the salvage oil. In a departure from the representation according to the flow scheme of FIG. 1, the feeding in of the salvage oil into the extraction column (13) may also follow at its upper or lower parts. The required solvent is introduced across conduit (16) into the lower part of the extraction column (13). In countstream, the solvent takes up the components of the salvage oil that are soluble under the above-mentioned operational conditions, whereas the insoluble components, together with the impurities, are collected in the sump of extraction column (13) and are discharged from their with standard control across conduit (17). The valve (18) serves therewith for regulation of the outflow of extraction residue from extraction column (13). The required relaxation of the extraction residue to a pressure form 1 to 0.01 bar occurs in relaxation (flash) container (19). The gaseous solvent set free herewith is discharged across conduit (20). In order to assist in the relaxation, the relaxation container (19) can be heated and provided with stirring means. The upper part of extraction column (13) operates as so-called repeater part. The top product produced thereat is discharged across conduit (21) and led into the vapor-heated heat exchanger (22), in which the necessary reflux is attained by means of slight temperature elevation, since upon temperature elevation the solubility of the oil in the super-critical solvent decreases. In subsequently provided separator (23) the oil that has condensed out is separated and then re-introduced into extraction column (13) with the aid of pump (24) across conduit (25). In extraction column (13), it is delivered as reflux to the top of the column.

The loaded solvent is led from the separator (23) across conduit (26) into the high-pressure separator (27) in which in the present case a total separation of the oil phase from the solvent is effected. Herewith the separated oil phase, which represents the extract, is discharged (level controlled) from the lower part of the high-pressure separator (27) and led across column (28) into the low-pressure separator (29), in which takes place the separation of the solvent residue still remaining in the oil phase. The amount of discharge across conduit (28) is regulated by means of valve (30). The solvent-free product oil is discharged across conduit (31) from the low-pressure separator (29), and led across conduit (31) into the collection container (32). From here, the product oil is forwarded by way of pump (34) located in conduit (33) and heat-exchagner (35) into the hydrogenation reactor (36), in which the catalytic hydrogenation of the product oil takes place in the presence of commercially available hydrogenation catalysts which contain, for example, nickel as active component. The hydrogen necessary for this is introduced into the hydrogenation reactor (36) by means of conduit (37). The halogen and sulphur compounds contained in this product oil are converted by means of the hydrogenation thereof into hydrogen halides, respectively hydrogen sulphides. These products are discharged in gaseous form across conduit (38) drom dehydrogenation reactor (36). The hydrogenated product oil is led at this time across conduit (39) into supplementing container (40) into which can be introduced by way of conduit (41) bleaching earth, which is admixed in supplementing container (40), with stirring, to the hydrogenated product oil. The bleaching earth/oil mixture is then led across pump (42) and conduit (43) into vacuum distillation column (44), in which it is distilled at a vacuum between 0.002 and 0.1 bar and thereby broken down into various fractions. To the extent that an addition fo bleaching earth can be avoided, the hydrogenated product oil is led directly across conduit (39) into vacuum distillation column (44). In this case, the diesel oil II is discharged across conduit (45) and the spindle oil across conduit (46). The distillation residue occurring in vacuum distillation column (44) is brought by means of pump (48) in conduit (47) into the filter device (49), in which the bleaching earth is separated by means of filtration. This oil-fouled bleaching earth is led across conduit (51) into gasifier (52) while the base oil occurring upon the filtration is discharged across conduit (50) from filter plant (49).

Aside from the oil-fouled bleaching earth, the following products are introduced into gasifier (52): the extraction residue from relaxation container (19) across conduit (53) and pump (54); the diesel oil I from separation container (9) across conduit (10); as well as the clear slime from biological waste water purification plant (55) across conduit (56). Gasifier (52) can be a so-called flow stream gasifier, which operates according to the known Kopers-Tatzek technique. Serving as gasification medium in this connection, may be e.g., oxygen and/or air, as well as, if necessary, small amounts of water vapor. The gasification can be performed under elevated pressure conditions. Insofar as liquids or suspensions are supposed to be gasified, the gasifier is equipped with so-called injector (nozzle) burners. The burners can, additionally, have predisposed heat exchangers in which the product to be gasified is brought to the temperature required for the adjustment of the necessary viscosity.

The product introduced into gasifier is gasified in a flame reaction at temperatures between 1300° C. and 2000° C. The additional fuel necessary in some cases for this is led across conduit (57) into gasifier (52). The necessary air or oxygen is led into the gasifier across conduit (58). The resulting gas, composed essentially of components carbon monoxide, hydrogen, carbon dioxide, water and nitrogen are discharged across conduit (59) from gasifier (52) and led across heating kettle (60) into the pressurized water wash (61). Also introduced into pressurized water wash (61) is the gas stream from conduit (38), so that both gas streams run together through any subsequent gas treatment. This involves pressurized water wash (61) and pressurized caustic wash (62), whereby the individual stages are connected together through conduits (63) and (64). By means of this gas treatment, not only hydrogen halides and hydrogen sulphide, but also the metal compounds stemming from the oil additives, are removed from the gas. Since the gas in heating kettle (60) is already pre-cooled to the required extent, the gas discharged across conduit (65) after passing through both washing stages can be employed without problem as heating gas. The gasification residue (slush) is discharged across conduit (66) from the gasifier in molten liquid state and granulated and cooled in a water bath (not shown).

The solvent escaping form high pressure separator (27) across the top is discharged over conduit (67) and led through heat exchanger (68) into conduit (16) by means of which solvent is re-introduced into extraction column (13). Since the solvent circulation is nearly isobaric, only a slight pressure increase must be effected by means of circulation compressor (69). The heat exchangers (68) and (70) serve herewith for the required adjustment of temperature of the solvent.

The solvent emitted from low pressure separator (29) is discharged across conduit (71) and led, after being compressed to condensation pressure in compressor (72), into condenser (73) in which it is liquified. Heat exchanger (74) serves, moreover, for the necessary adjustment of temperature. Conduit (20), across which is discharged the solvent set free in relaxation container (19), empties into conduit (71) before the heat exchanger (74). The liquified solvent is collected in receiving vessel (75), and from there fed in as needed to conduit (16) across conduit (77) by means of compressor (76). The water separated in separation container (9) is led across conduit (11) into the biological waste water purification plan (55), from which the purified waste water is introduced across conduit (78) into the main canal (receiving stream). The clear slime produced by the waste water purification is introduced, as already mentioned above, across conduit (56), to gasifier (52).

As evidenced by the above-depicted process, it is possible by means of a complex solution to the problems of elimination to perform the working up of the salvage oil in a super-critical extraction in such manner that the environment is clearly less burdened in comparison to the previously-known techniques. Obviously, certain changes in the technical specifics are possible in a deviation from the preferred embodiments as set forth in the flow scheme of FIG. 1.

The applicants have alluded above to the fact that in certain circumstances it is also possible to eliminate the extraction residue by means of storage in a deposit. Since in this case the gasifier (52) has to be omitted, all of the other residues which according to the preferred embodiments above must otherwise be introduced into gasifier (52) are eliminated by means of storage in a deposit or in some other manner. In the interest of an as comprehensive as possible environmental protection, the manner of operation described in the process examples depicted above is given preference.

Moreover, instead of the described total separation of the extract in single high pressure and low pressure separators (27) and (29), such separation can also follow, for example, in several stages. When such a fractionating separation of the product of the extract is performed, then the fractions resulting thereby are also to be hydrogenated individually, if necessitated by the halogen compounds present in the respective fractions.

It is possible, moreover, instead of the separate supply of diesel oil, extraction residue and bleaching earth into gasifier (52) as provided in the flow scheme of FIG. 1, to combine these products before entry into the gasifier, so that the bleaching earth is suspended in the extraction residue and diesel oil I. The addition of diesel oil to the extraction residue before the gasification is also indicated when the extraction residue displays too high a viscosity, since thereby the viscosity can be lowered.

Finally, it is possible in many cases to avoid a purification of the waste water flowing from separation container (9), gasifying the water with the extraction residue instead. Generally, most such cases will require an additional provision of fuel in gasifier (52). If necessary, liquid, hydrocarbon-containing waste materials, such as for example, salvage oil laden above permissible limits with impurities, can be employed.

The effectiveness of the process according to the present invention is illustrated by the following operational example.

Wet salvage oil with 15% water and 5% diesel oil I (KP less than 170° C.) in an amount of 175 kg/h are brought to distillation column (7). 26 kg/h water and 9 kg/h diesel oil I are distilled off at 160° C. and 1 bar.

The drier oil leaving distillation column (7) is cooled to 43° C. across heat exchanger (15), compressed by means of pump (14) to 100 bar, and then delivered to extraction column (13) at the halfway mark thereof. Ethane at 43° C. and 100 bar is introduced as solvent at the foot of extraction column (13).

In the lower part of the column which is filled with Raschig rings, the soluble components of the drier oil are absorbed by solvent through counter stream extraction. The laden solvent phase is introduced to heat exchanger (22) (dephlegmator) and heated to 48° C. A partial separation of the non-volatile hydrocarbons (denatured additives) which flow counter stream through the increasingly laden solvent phase and effect a stripping action, is provided herewith, whereby an additional separating effect is obtained. The delivered drier oil can be separated therewith in an extraction residue of 14 kg/h and in a valuable fraction of 126 kg/h. The extraction residue is discharged at the foot of extraction column (13), relaxed 1 bar, and heated to 150° C. The solvent thereby set free is recompressed and introduced into the main solvent stream.

The purified solvent phase (extract) is freed of dissolved products in connection with heat exchanger (22) in the subsequently provided high pressure separator (27) by means of heating to 150° C. at 100 bar. The separated product is discharged in amount of 126 kg/h at the bottom of high pressure separator (27), and for separation of the solvent still dissolved therein, relaxed to 1 bar in low pressure separator (29). The solvent thus set free is recompressed and combined with the main solvent stream.

The separated product is subjected to a hydrogenation in hydrogenation reactor (36) for destruction of the halogen hydrocarbons present therein, and then separated into the products base oil, spindle oil and diesel oil II in vacuum distillation column (44). The product delviered to vacuum distillation is reacted with 2.8 kg/h bleaching earth. The oil-fouled bleaching earth is filtered off from the bottom product of vacuum distillation in filter plan (49). 74 kg/h base oil, 35 kg/h spindle oil and 45 kh/h diesel oil II, as well as 5.6 kg/h oil-fouled bleaching earth are obtained.

The extraction residue, pre-heated to 152° C., is compressed to the required pre-pressure of gasififer (52). The diesel oil I is admixed with the oil-laden bleaching earth and the small amount of clear slime produced from biological waste water purification (55), the resulting mixture likewise being compressed to the require pre-pressure of gasifier (52) and delivered together with the extraction residue to gasifier (52) at about 150° C. This mixture is gasified in gasifier (52), with an addition of 0.95 kg of oxygen per kg mixture as oxidation agent in a flame reaction at temperatures above 1500° C. The product of the gasification includes carbon monoxide and hydrogen in a ratio approximately 2.1:1, as well as small amounts of carbon dioxide and water vapor, also traces of hydrogen sulphide and hydrogen chloride. The metal content of the residue is oxidized and discharged from the gasifier as ash or fine dust. The hot crude gas still laden with slight amounts of fine dust is subjected to the above-described gas treatment, whereby heating gas, waste vapor and salt-containing liquor are obtained. In order to avoid a separate washing of the HCl-containing exhaust gas produced by the hydrogenation, it is admixed to the crude gas from the gasification before the gas treatment.

The following table serves for a summarization of the results of the depicted process insofar as degradation of the harmful substances such as PCB, PCT, chloroalkane and metal content of the salvage oil:

| OUTLET SUBSTANCE AND PRODUCTS | TOTAL CHLORINE PPM | PCB/PCT PPM | METAL CONTENT PPM |
|---|---|---|---|
| Salvage oil (wet) | 1000 | 50 | 2588 |
| Base oil | 11 | 0.5 | — |
| Spindle oil | 11 | 0.5 | — |
| Diesel oil II | 11 | 0.5 | — |
| Heating gas | — | — | — |

It will be understood that each of the elements described above, or two or more together, may also find a useful application in other types of hydrocarbon modifications differing from the types described above.

While the invention has been illustrated and described as embodied in the working up of salvage oil, it is not intended to be limited to the details shown, since various modifications and structural changes may be made without departing in any way from the spirit of the present invention.

Without further analysis the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Process for the working up of salvage oil, by subjecting previously dewatered salvage oil to an extraction under supercritical conditions with a solvent which is gaseous at normal conditions and separating extracted components from a separated supercritical gas phase through lowering of pressure or alteration of temperature, comprising (a) removing solid impurities present in said salvage oil by filtration;

(b) subjecting filtered salvage oil to an atmospheric distillation;

(c) subjecting previously distilled salvage oil to a supercritical extraction, thereby producing a separated supercritical gas phase containing extract components, and separating said extract components from said separated supercritical gas phase in a single step or fractionally;

(d) removing from separated extract components any solvent residue still remaining therein through single or multiple stage relaxation;

(e) subjecting solvent-free extract components to a catalytic hydrogenation, thereby producing a gas stream, and purifying said gas stream by pressurized washing with water or caustic soda;

(f) removing from an extraction residue produced by said extraction any solvent dissolved therein by single or multiple stage relaxation;

(g) eliminating said solvent-free extraction residue through thermal treatment composed of gasifying the solvent-free extraction residue in a flame reaction in the presence of oxygen or air and removing from a gas so produced, composed essentially of $CO$, $H_2$, $CO_2$, $H_2O$ and $N_2$, any undesirable components by a subsequently disposed gas purification; and (h) combining solvent recovered from said extraction residue with solvent recovered from said extract components, condensing said solvent and adding said condensed solvent to a main solvent stream which is led back to said extraction stage.

2. The process according to claim 1, wherein said atmospheric distillation is performed within a temperature range between 120° C. and 250° C.

3. The process according to claim 1, wherein said supercritical extraction is performed at a pressure between 50 and 150 bar and within a temperature range between 20° C. and 80° C.

4. The process according to claim 1, wherein said separating of extract components from said gas phase is performed at a pressure between 50 and 150 bar and within a temperature range between 40° C. and 200° C.

5. The process according to claim 1, wherein said removing from separated extract components any solvent residue is performed within a temperature range between 40° C. and 200° C. to a pressure from 1 to 0.01 bar.

6. The process according to claim 1, wherein said catalytic hydrogenation is performed at a pressure from 50 to 150 bar and within a temperature range between 250° C. and 400° C.

7. The process according to claim 1, wherein said removing from an extraction residue any solvent is performed within a temperature range between 40° C. and 200° C. to a pressure from 1 to 0.01 bar.

8. The process according to claim 1, wherein said hydrogenated extract is fractionated by vacuum distillation.

9. The process according to claim 8, further comprising prior to its being fractionated by vacuum distillation, adding to said hydrogenated extract bleaching earth in an amount up to 5% by weight.

10. The process according to claim 1, wherein said gasifying is performed at a temperature within the range between 1300° C. and 2000° C.

11. The process according to claim 1, wherein said undesirable components comprise metal compounds stemming from oil additives.

12. The process according to claim 1, wherein a product of said atmospheric distillation of said salvage oil is diesel oil I and further comprising gasifying said diesel oil I together with said extraction residue.

13. The process according to claim 12, wherein said diesel oil I is admixed with said extraction residue prior to said gasifying, for the purpose of lowering viscosity.

14. The process according to claim 9, wherein said vacuum distillation of said hydrogenated extract results in oil-fouled bleaching earth, and further comprising suspending said oil-fouled bleaching earth in said extraction residue and said diesel oil I and gasifying thereof.

15. The process according to claim 1, wherein a product of said atmospheric distillation of said salvage oil is water, and further comprising gasifying said water with said extraction residue.

16. The process according to claim 15, further comprising an addition of fuel for said gasification of said water.

17. The process according to claim 15, further comprising prior to said gasifying, adding liquid, hydrocarbon-containing waste material to said water.

18. The process according to claim 15, further comprising said water is worked up in a biological waste water purification prior to said gasifying, said purification producing a clear slime which is gasified together with said extraction residue.

19. The process according to claim 1, wherein said solvent for said extraction comprises ethane or propane as well as mixture thereof.

20. The process according to claim 19, wherein said solvent employed for said extraction further contains an addition of butane.

* * * * *